US011484930B2

(12) United States Patent
Valterio

(10) Patent No.: US 11,484,930 B2
(45) Date of Patent: Nov. 1, 2022

(54) PUNCHING TOOL COMPRISING A PUNCH AND A DIE

(71) Applicant: BOBST MEX SA, Mex (CH)

(72) Inventor: Roberto Valterio, Ollon (CH)

(73) Assignee: BOBST MEX SA, Mex (CH)

( * ) Notice: Subject to any disclaimer, the term of this patent is extended or adjusted under 35 U.S.C. 154(b) by 340 days.

(21) Appl. No.: 16/627,608

(22) PCT Filed: Jun. 25, 2018

(86) PCT No.: PCT/EP2018/025173

§ 371 (c)(1),
(2) Date: Dec. 30, 2019

(87) PCT Pub. No.: WO2019/007554

PCT Pub. Date: Jan. 10, 2019

(65) Prior Publication Data

US 2020/0122213 A1 Apr. 23, 2020

(30) Foreign Application Priority Data

Jul. 6, 2017 (DE) ..... 102017115167.2

(51) Int. Cl.

| | |
|---|---|
| ***B21D 13/00*** | (2006.01) |
| ***B21D 13/02*** | (2006.01) |
| ***B31F 1/08*** | (2006.01) |
| ***B21D 22/04*** | (2006.01) |
| ***B21D 17/02*** | (2006.01) |

(52) U.S. Cl.

CPC ..... *B21D 13/02* (2013.01); *B21D 17/02* (2013.01); *B21D 22/04* (2013.01); *B31F 1/08* (2013.01)

(58) Field of Classification Search

CPC ..... B21D 13/02; B21D 13/04; B21D 17/02; B21D 22/02; B21D 22/04; B23P 15/406; B31B 50/252

See application file for complete search history.

(56) References Cited

U.S. PATENT DOCUMENTS

| | | | |
|---|---|---|---|
| 3,643,483 | A | 2/1972 | Minchenko et al. |
| 3,847,036 | A | 11/1974 | Miller |
| 3,884,132 | A | 5/1975 | Snodgrass |
| 6,276,045 | B1 | 8/2001 | Büchi et al. |
| 2007/0072758 | A1 | 3/2007 | Van Oosterhout |

(Continued)

FOREIGN PATENT DOCUMENTS

| | | |
|---|---|---|
| CH | 463258 | 9/1968 |
| CN | 202591370 U | 12/2012 |

(Continued)

OTHER PUBLICATIONS

International Search Report (3 pages) issued in related PCT/EP2018/025173, dated Oct. 24, 2018.

*Primary Examiner* — Debra M Sullivan

(74) *Attorney, Agent, or Firm* — Bookoff McAndrews, PLLC

(57) ABSTRACT

A punching tool comprising a punch (42) and a die (46), in particular for manufacturing a creasing plate (24), the die having a straight recess (50) for accommodating material deformed by the punch (42), characterized in that the die (46) has an outer contour which extends, adjacent the open end of the recess (50), at an angle of less than 90° with respect to the longitudinal direction of the recess (50).

16 Claims, 19 Drawing Sheets

(56) References Cited

U.S. PATENT DOCUMENTS

Figure 1:
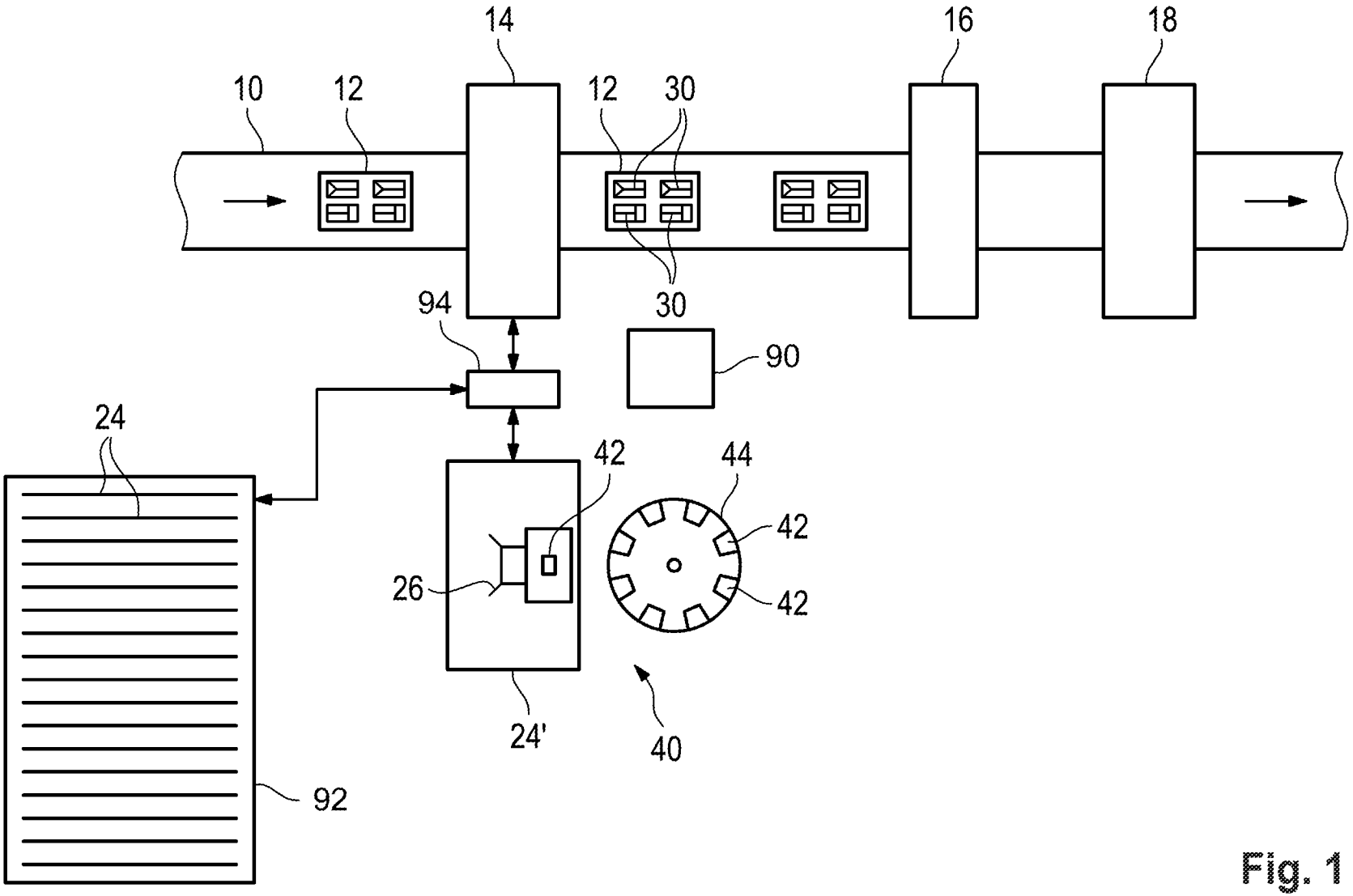

| | | | | |
|---|---|---|---|---|
| 2010/0095726 | A1* | 4/2010 | Buettner | B21D 22/04 72/203 |
| 2011/0185576 | A1* | 8/2011 | Keller | F01N 13/141 29/700 |
| 2015/0165504 | A1* | 6/2015 | Fukunaga | B21D 28/12 72/379.2 |

FOREIGN PATENT DOCUMENTS

| | | | | |
|---|---|---|---|---|
| CN | 103071717 | A | 5/2013 | |
| CN | 105358269 | A | 6/2013 | |
| CN | 204149582 | U | 2/2015 | |
| DE | 1257168 | B | 12/1967 | |
| DE | 19619496 | A1 | 12/1996 | |
| DE | 10062294 | A1 | 6/2002 | |
| DE | 102009028003 | A1 | 1/2011 | |
| EP | 3015185 | | 5/2016 | |
| EP | 3015185 | B1 * | 3/2017 | B21D 22/02 |
| JP | H10286893 | A | 10/1998 | |
| JP | 2003165166 | A | 6/2003 | |
| JP | 2005193523 | A | 7/2005 | |

* cited by examiner

PUNCHING TOOL COMPRISING A PUNCH AND A DIE

CROSS-REFERENCE TO RELATED APPLICATION(S)

This application is a National Stage under 35 U.S.C. § 371 of International Application No. PCT/EP2018/025173, filed Jun. 25, 2018, which claims priority to German Patent Application No. 102017115167.2, filed Jul. 6, 2017, the contents of all of which are incorporated by reference in their entirety.

The invention relates to a punching tool comprising a punch and a die, in particular for deforming sheet metal so as to create local projections which can be used as creasing projections for generating creases in sheet materials.

Creasing machines are used for generating one or more creases in a sheet from which blanks are cut which are folded. Each of the creases forms kind of a "hinge" which allows the later formed blanks to be folded at a well defined place.

The creasing machine can be formed as a device or system which is either a standalone unit or is integrated into a larger machine or system such as a printing machine or a finishing machine.

The sheets can be made from cardboard, carton or a foil, and they can be provided to the creasing machine separately or in a continuous manner as part of a web.

The creases are formed by locally applying a pressure onto the sheet. To this end, creasing knives are known which are pressed onto the surface of the sheet so as to generate the crease. It is also known to provide local projections on the creasing tool, for example by etching away those portions of the creasing tool which shall not project, or by locally applying a plastic material in a liquid condition, which is then cured.

The creasing tool can either be generally flat and be moved back and forth in a direction which is generally perpendicular with respect to the plane in which the sheet extends, or it can be generally cylindrical and be rotated so as to engage at the sheet when it is being transferred through the creasing area.

The problem with all creasing machines is that they can hardly be quickly adapted to a specific pattern of creases to be applied to a sheet. This has become more of a problem since digital printing allows changing very quickly from one printing job to a different one.

Assuming that the creasing tool is to be manufactured by means of an etching process, it may take several hours until a new creasing tool is available. Assuming that the creasing projections are formed by applying a plastic material to a carrier, the manufacturing times might be shorter, depending on the time which is necessary for curing the plastic material. However, the lifetime of such a creasing tool is significantly shorter than the lifetime of a creasing tool comprising an etched steel plate. In any case, the step of adapting the creasing machine to a new creasing job is the bottleneck when the creasing machine is used in connection with a digital printing machine.

The object of the invention is to provide a punching tool with which a creasing plate can be quickly manufactured so that it is available in a flexible manner for working on a new creasing job.

In order to achieve this object, the invention provides a punching tool comprising a punch and a die, in particular for manufacturing a creasing plate, the die having a straight recess for accommodating material deformed by the punch, characterized in that the die has an outer contour which extends, adjacent the open end of the recess, at an angle of less than 90° with respect to the longitudinal direction of the recess. Owing to the special contour of the die, it is possible to generate creasing projections in a creasing plate, which terminate at a small distance from each other. This is particularly advantageous as it allows generating creases in a sheet to be folded, between which only a very small portion of uncreased material is present so that the folds are very precise.

Preferably, the angle is in the order of 45°. The advantage of this geometry is that merging creasing projections can be generated which extend at an angle of 45° with respect to each other.

According to a preferred embodiment, the punch has a projection with rounded end portions. The rounded end portions help in ensuring a smooth transition between the individually deformed areas so as to create a continuous creasing projection.

Depending on the geometry of the creasing projection, the rounded end portions have at least one of a large and a small radius. A large radius is advantageous for achieving a smooth transition between the separately deformed areas which form the creasing projection. A small radius is advantageous for creating a creasing projection which either terminates in a very small distance from an adjacent creasing projection, or which even intersects with the adjacent creasing projection.

Regarding the large radius provided at a forward or rearward end of the projecting portion of the punch, values in the order of 2 to 15 mm have shown to be beneficial in that they ensure a smooth transition from the deformed material of the creasing projection towards the undeformed material.

Regarding the small radius provided at a forward or rearward end of the projecting portion of the punch, values in the order of 0.2 to 2 mm have shown to allow the desired small distance between adjacent creasing projections while at the same time ensuring that there is no damage to the deformed material of the creasing plate.

According to an embodiment, the punch extends along a straight line and has a length, measured along the straight line, in the order of 5 to 50 mm. The longer the punch, the less individual strokes are necessary for generating a creasing projection. However, shorter punches increase the flexibility and decrease the force which is necessary for deforming the creasing plate.

According to a preferred embodiment of the invention, an elastic ejector is associated with the die. The ejector helps pushing the plastically deformed material out of the die. Further, it prevents that the creasing plate be scratched by touching the die.

The elastic ejector can have the form of a plate made from rubber or an elastomer. Such plate can be cut in a very precise manner by waterjet cutting.

Preferably, the ejector surrounds the die. This allows mounting the elastic ejector to the die by simply forming the elastic ejector with a suitable inner contour adapted to the outer contour of the die.

In view of the aim of generating creasing projection, it has been found out that a height of the projecting portion of the punch in the order of 1.0 to 2.0 is advantageous, in particular in the order of 1.6 mm.

Further, the projecting portion can have at its apex a radius, when viewed in a cross section perpendicularly to the longitudinal direction of the projection portion, which is in the order of 0.1 to 0.5 mm.

Still further, the projecting portion has, when viewed in a cross section perpendicularly to the longitudinal direction of the projection portion, a width in the order of 0.5 to 4 mm.

Figure 2:
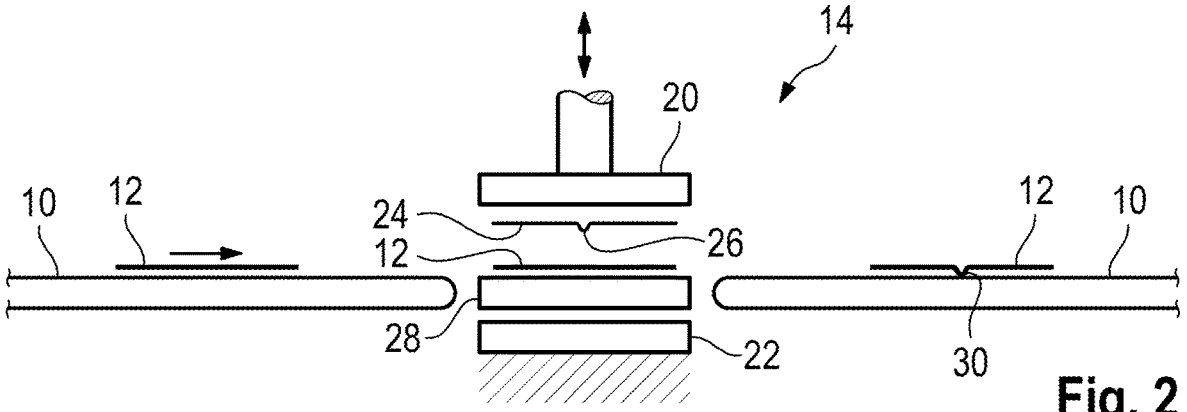
Figure 3:
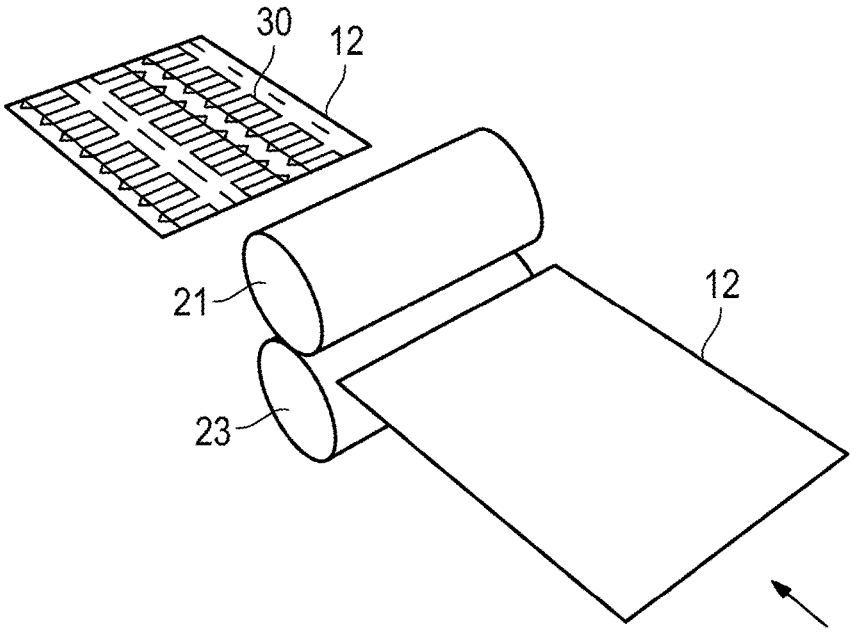
Figure 4:
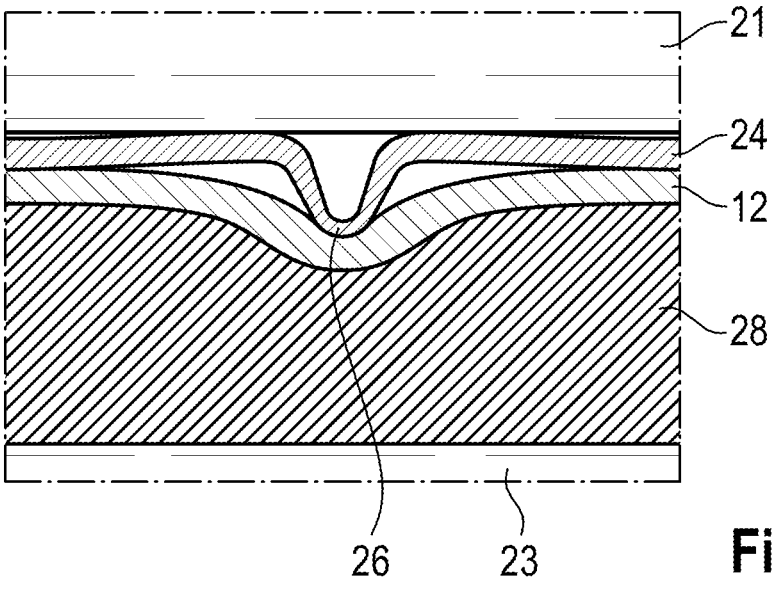
Figure 5:
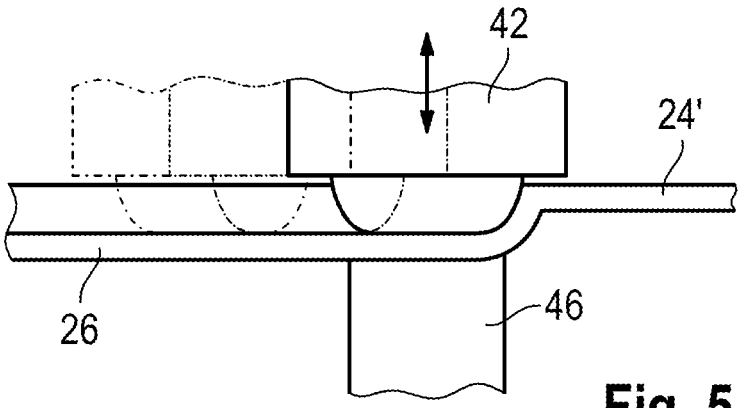
Figure 6A:
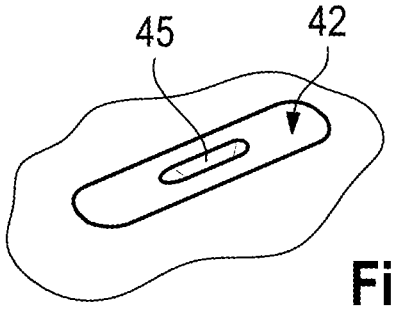
Figure 6B:
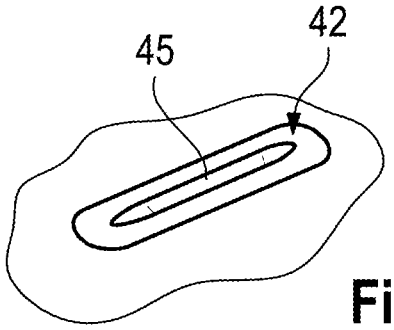
Figure 6C:
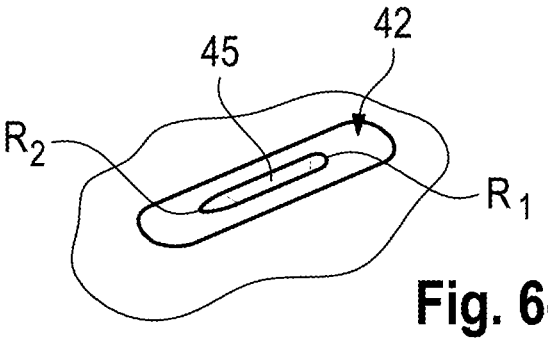
Figure 7A:
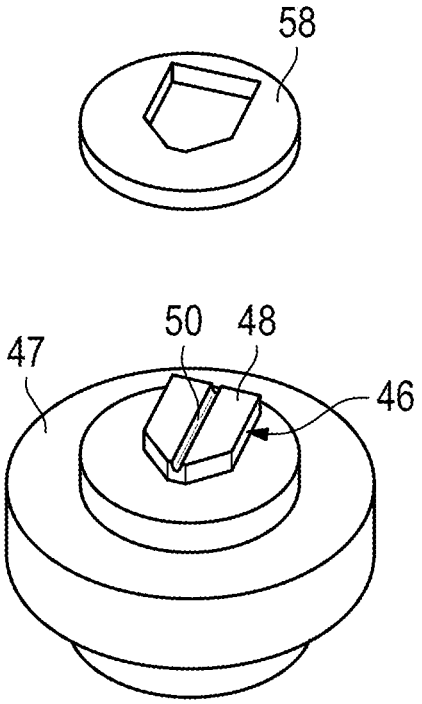
Figure 7B:
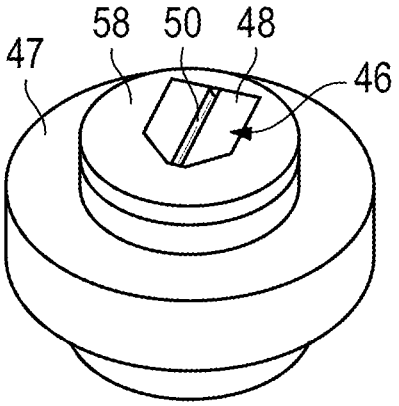
Figure 8:
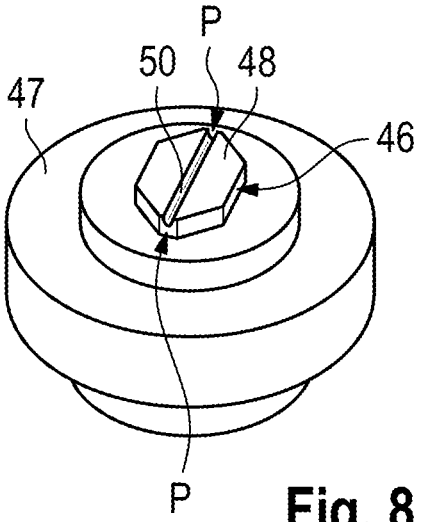
Figure 9:
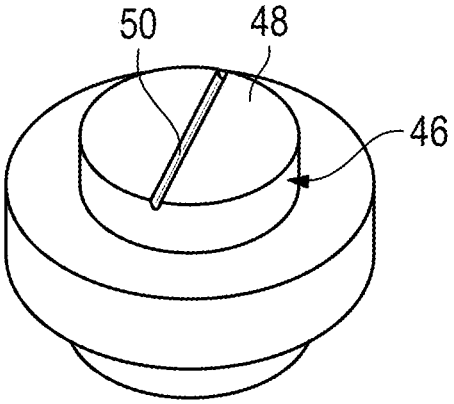
Figure 10:
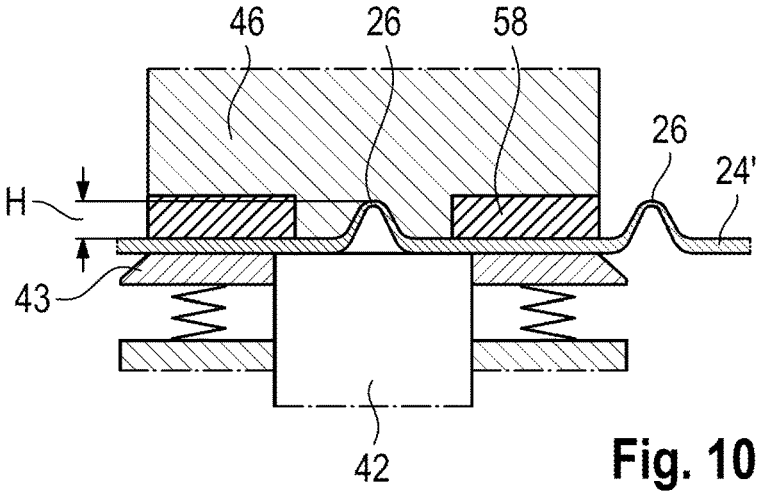
Figure 11A:
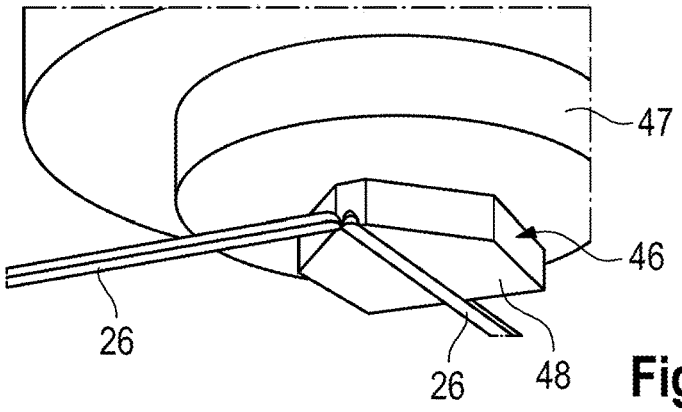
Figure 11B:
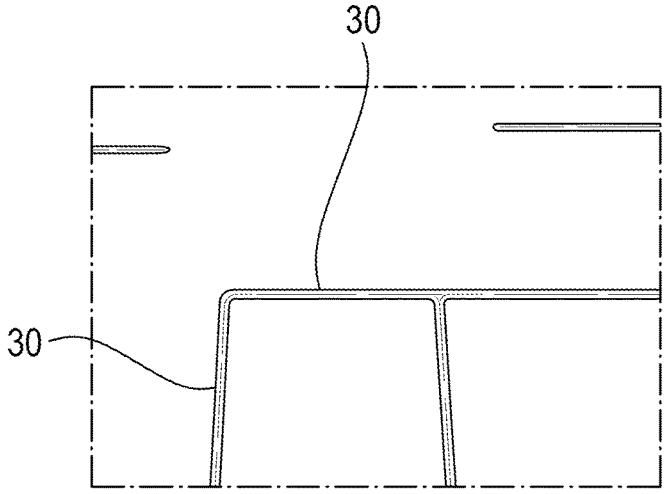
Figure 12A:
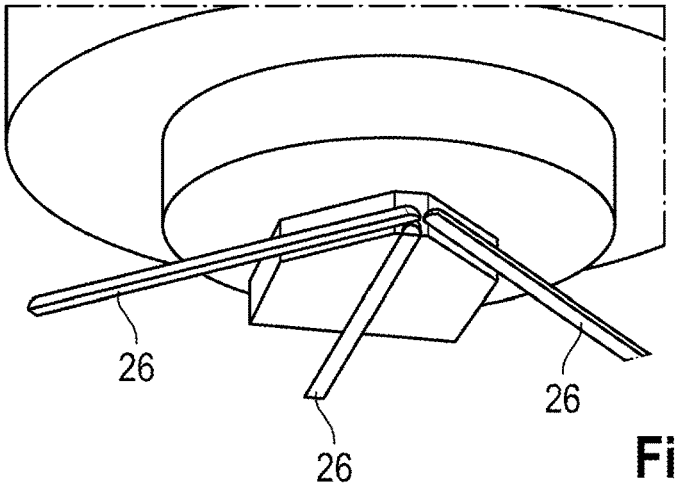
Figure 12B:
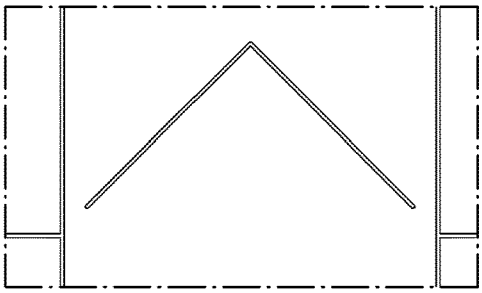
Figure 12C:
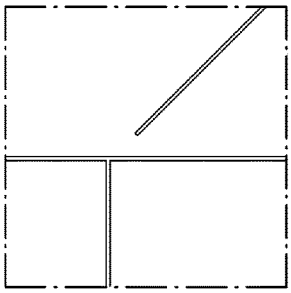
Figure 12D:
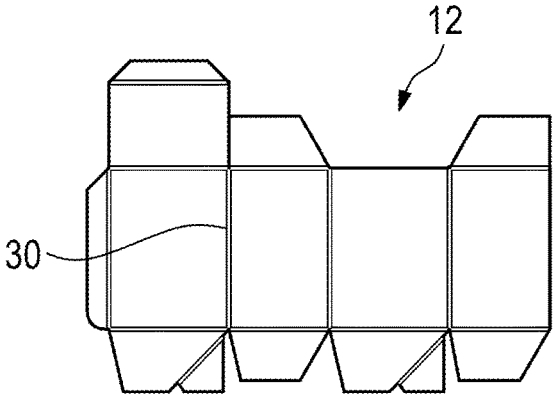
Figure 12E:
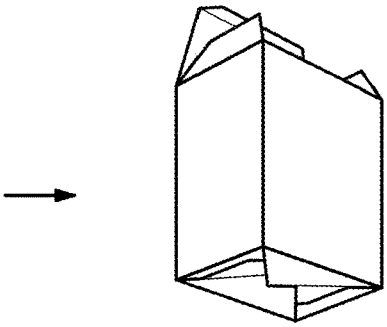
Figure 13A:
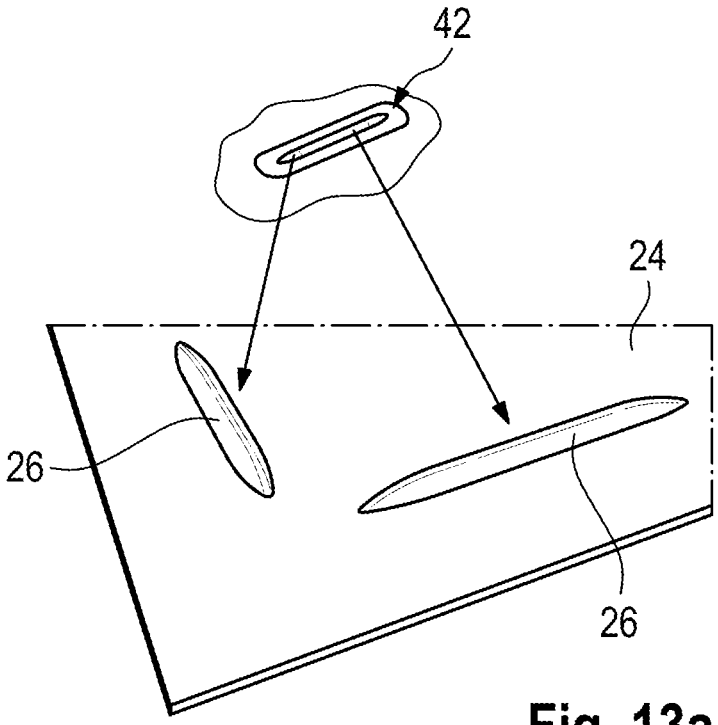
Figure 13B:
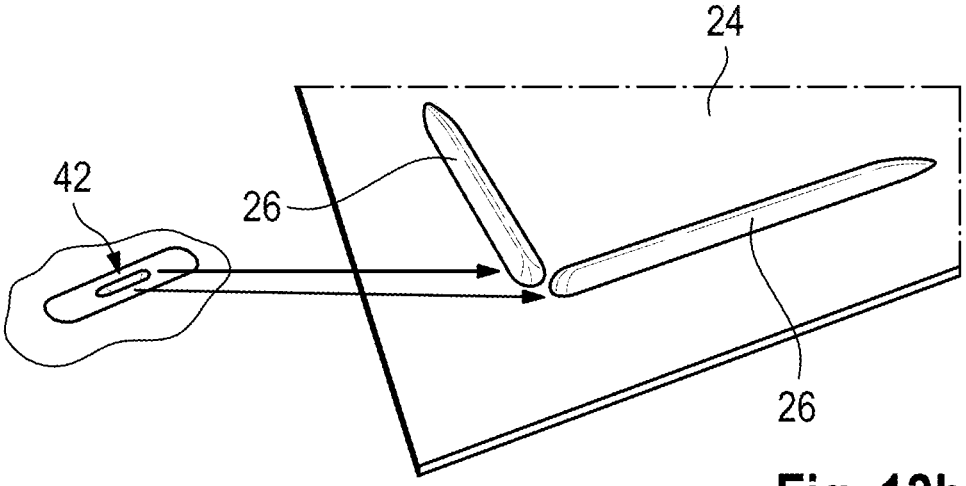
Figure 15A:
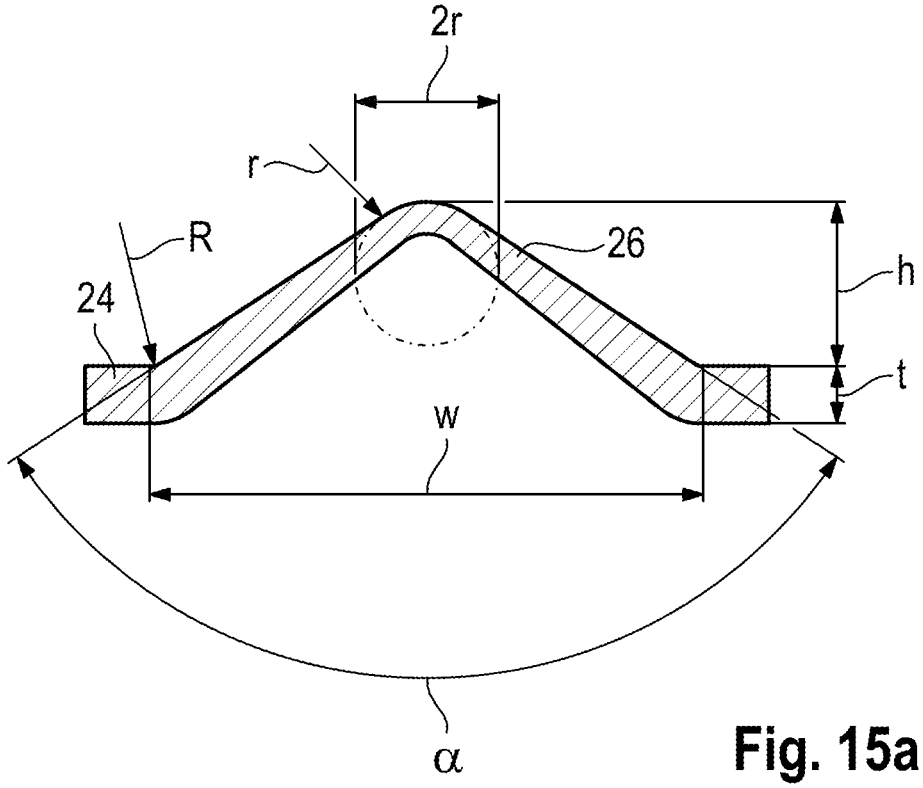
Figure 15B:
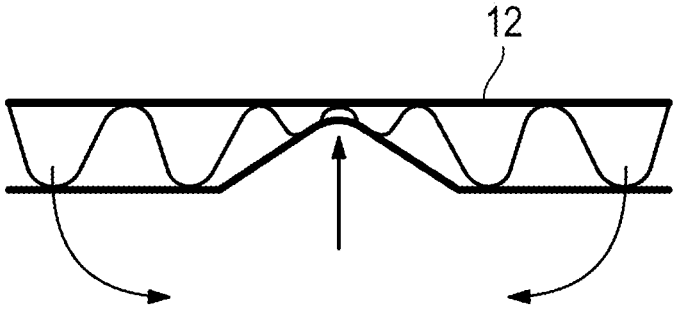
Figure 16B:
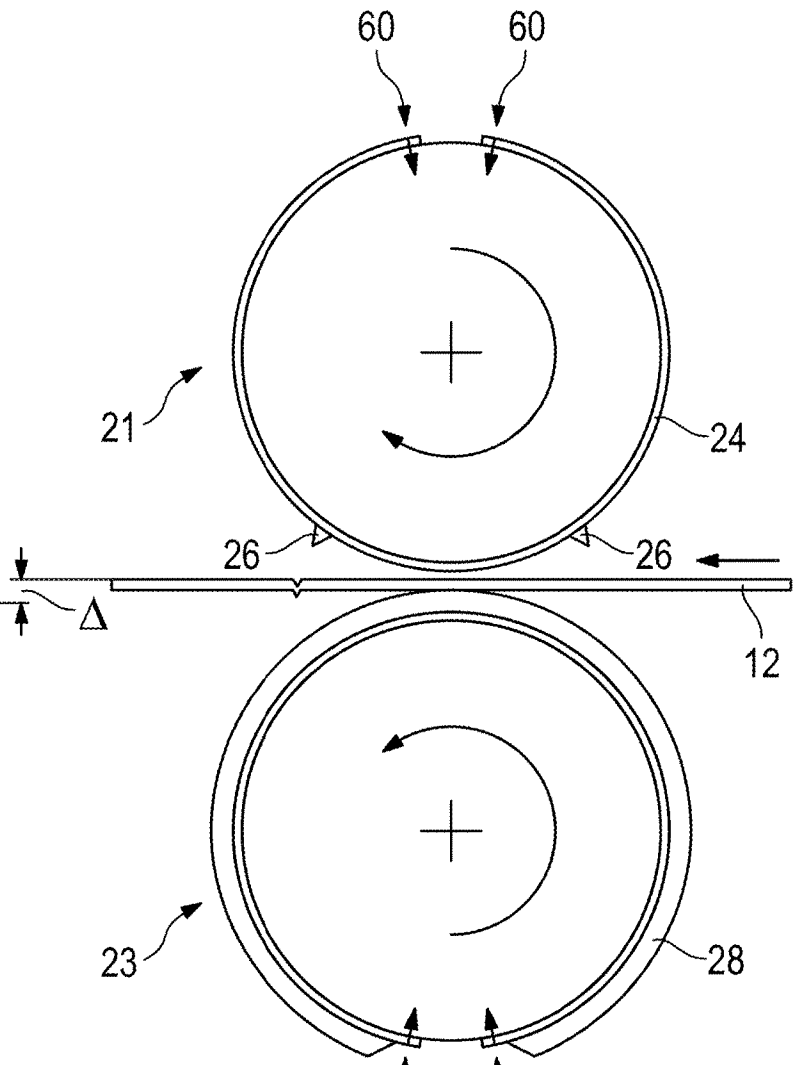
Figure 16A:
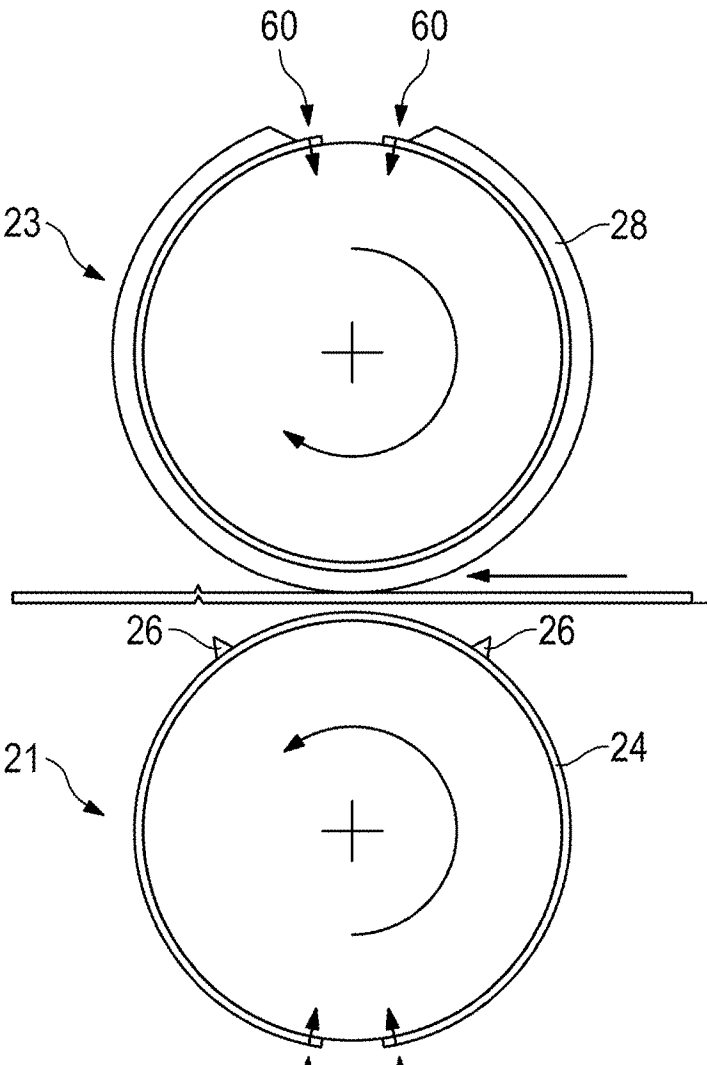
Figure 17:
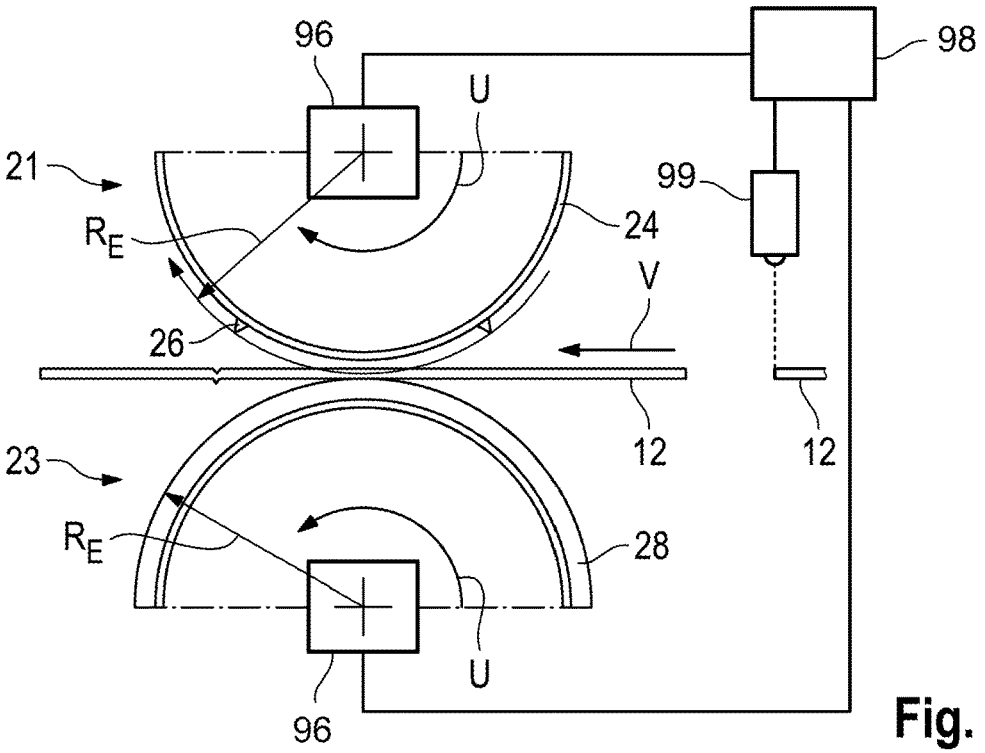
Figure 18:
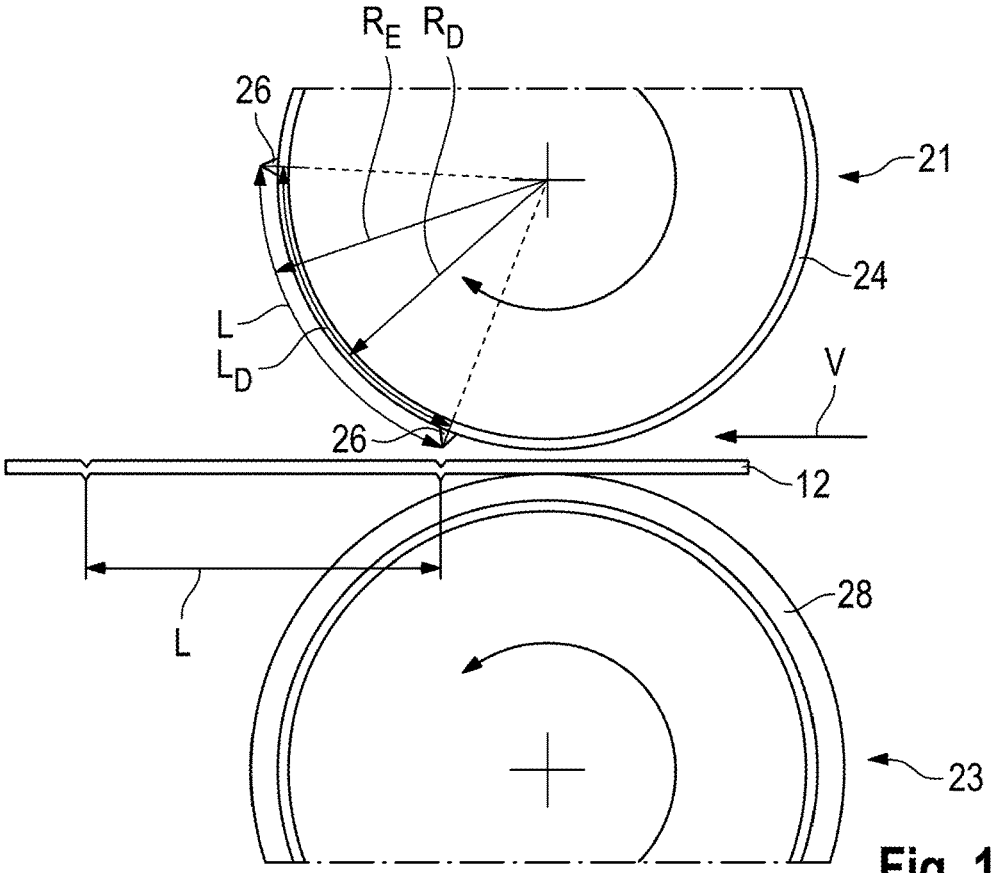
Figure 19:
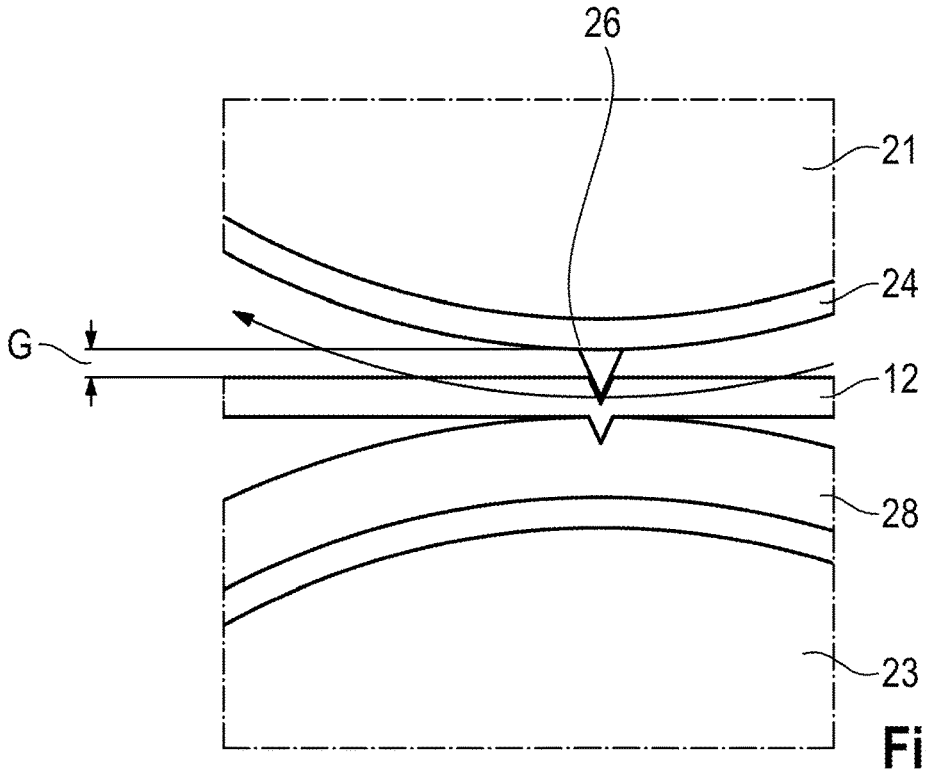
Figure 20A:
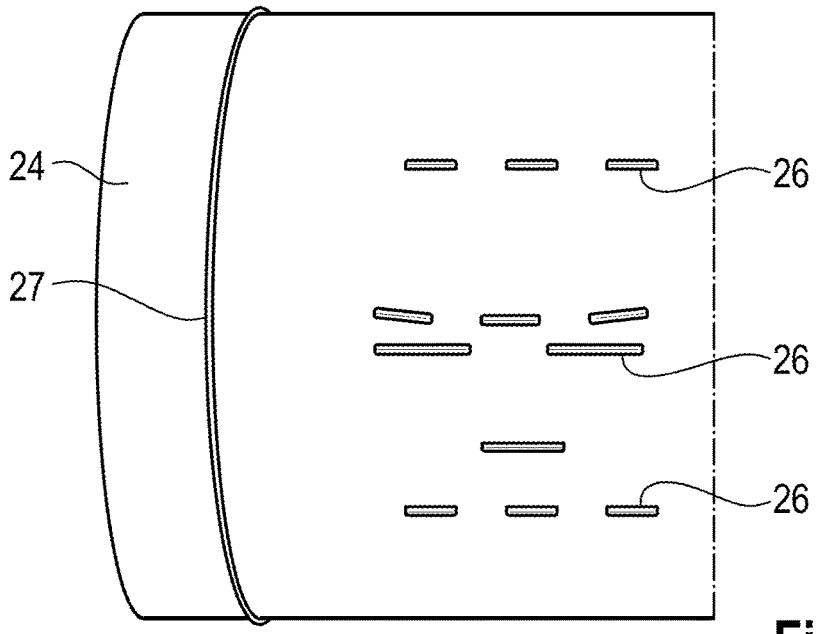
Figure 20B:
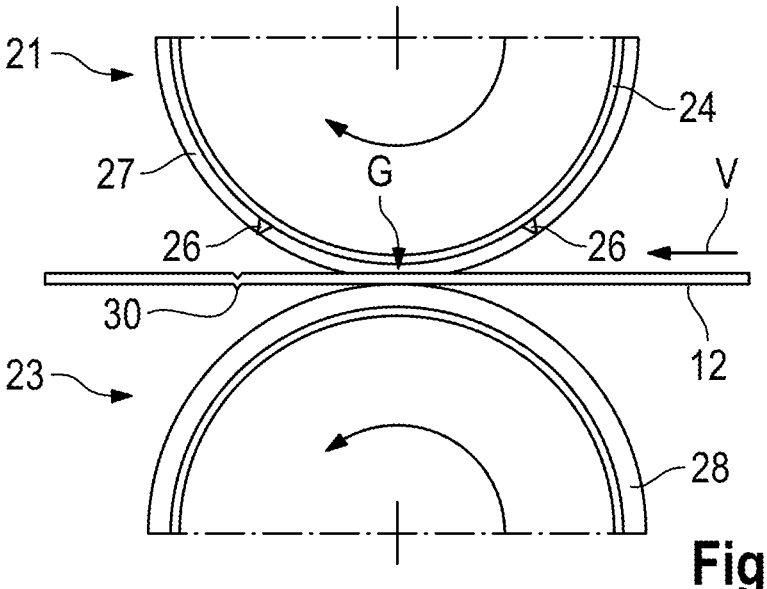
Figure 20C:
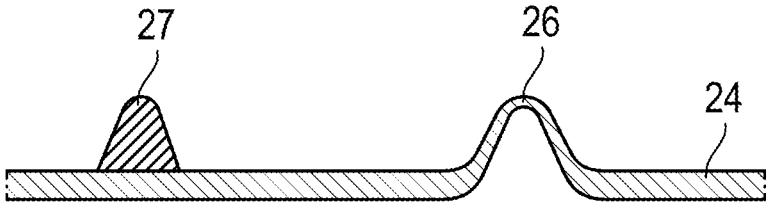
Figure 21A:
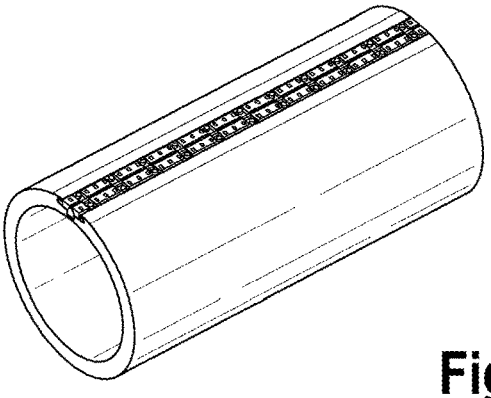
Figure 21B:
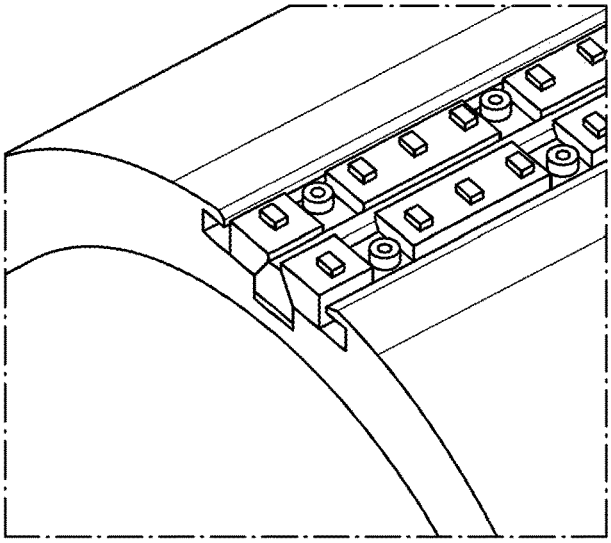
Figure 21C:
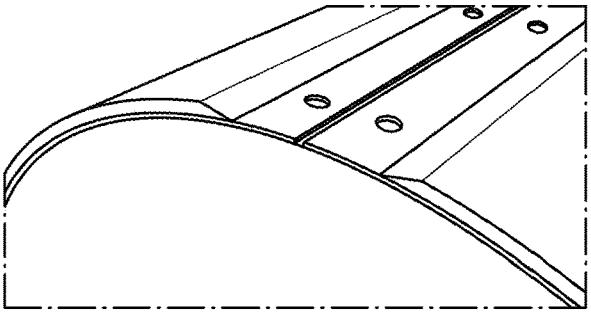

The invention will now be described with reference to the enclosed drawings. In the drawings, FIG. 1 schematically shows a creasing machine, FIG. 2 schematically shows one embodiment of the creasing tool used in the creasing machine of FIG. 1, FIG. 3 schematically shows a second embodiment of a creasing tool used in the creasing machine of FIG. 1, FIG. 4 shows a cross section through a creasing plate mounted to the creasing tool and generating a folding crease by pressing the sheet against the counter element, FIG. 5 schematically shows the process of creating a creasing projection on a creasing plate, FIGS. 6*a* to 6*c* show three different embodiments of punches used in the creasing machine of FIG. 1, FIGS. 7*a* and 7*b* show a first embodiment of a die used in the creasing machine of FIG. 1, FIG. 8 shows a second embodiment of the die used in the creasing machine of FIG. 1, FIG. 9 shows a die according to the prior art, FIG. 10 shows a cross section through a punch and a die when deforming a creasing plate blank, FIGS. 11*a* and 11*b* schematically show the die of FIGS. 7*a* and 7*b* when generating two merging creasing projections, and the folding creases generated with these folding projections, and FIGS. 12*a* to 12*e* schematically show the die of FIGS. 7*a* and 7*b* used for manufacturing three merging folding projections, and the folding creases generated with these creasing projections as well as a corresponding blank cut from a sheet and a box manufactured from the blank, FIGS. 13*a* and 13*b* show in more detail creasing projections obtained with the punches of FIGS. 6*b* and 6*c*, FIGS. 14*a* and 14*b* show a cross section through creasing projections used for creasing carton, FIGS. 15*a* and 15*b* show in a cross section a creasing projection used for creasing corrugated carton and the crease obtained therewith, FIGS. 16*a* and 16*b* show the creasing tool of FIG. 3 in a first and in a second condition, FIG. 17 schematically shows the creasing tool in more detail in combination with a control of the speed of rotation of the cylinders, FIG. 18 shows a schematic cross section through the creasing tool for explaining the speed of rotation of the cylinders, FIG. 19 shows at a larger scale the area of contact between the two cylinders of the creasing tool and the sheet to be provided with the creases, FIGS. 20*a* to 20*c* show a top view on a creasing plate, a cross section through the creasing tool provided with a driving fillet and a cross section through part of a creasing plate provided with a driving fillet and a creasing projections, FIGS. 21*a* to 21*c* show a perspective view of a cylinder used in the creasing tool, an enlarged view of the clamping mechanism used for clamping the creasing plate and used for clamping the elastic layer of the counter cylinder, FIGS. 22*a* to 22*g* show different steps of using a counter cylinder according to an alternative embodiment, FIGS. 23*a* to 23*d* show the cylinder used in the creasing tool in more detail, and FIGS. 24*a* and 24*b* show the counter cylinder in more detail.

In FIG. 1, a creasing machine is schematically shown. It comprises a transportation system 10 for advancing sheets 12 through a creasing area 14 where folding creases can be applied to the sheets 12.

Additional processing stations 16, 18 may be provided as part of the creasing machine or associated therewith. Processing stations 16, 18 can be used for cutting, folding, gluing or otherwise processing the sheets 12 or articles produced therewith.

Sheets 12 can be made from cardboard, carton or foil, and they can later be processed so as to cut blanks from the sheets to form a package, a box, a wrapping, an envelope or a similar product.

Sheets 12 can be supplied to creasing area 14 either separately as shown in the Figure, or in the form of a continuous web guided through creasing area 14.

It is also possible to integrate into creasing area 14 a cutting system which allows separating the individual blanks from the sheet.

In creasing area 14, a creasing tool and a counter element cooperate so as to apply at least one folding crease to sheet 12. To this end, the creasing tool carries a creasing plate, the creasing plate being provided with creasing projections. The geometry and arrangement of the creasing projections on the creasing plate corresponds to the folding creases to be applied to the sheet.

A first example of the creasing tool and the counter element used in creasing area 14 is shown in FIG. 2.

The creasing tool is here in the form of a plunger 20 which can be advanced towards and pressed against a counter element 22. At plunger 20, a creasing plate 24 is mounted which is provided with at least one creasing projection 26. Only a single creasing projection 26 is shown here for increased clarity.

On the side facing plunger 20, counter element 22 is provided with an elastic layer 28 which preferably is formed from rubber or an elastomer.

The sheets 12 to be provided with a folding crease are advanced with transportation system 10 so as to be positioned between plunger 20 and counter element 22. Plunger 20 is then pressed against elastic layer 28 whereby creasing projection 26 creates a folding crease 30 by locally deforming sheet 12.

A second embodiment of the creasing tool and the counter element is shown in FIG. 3. Here, the creasing tool is provided in the form of a creasing cylinder 21, and the counter element is in the form of a counter cylinder 23. Accordingly, creasing plate 24 is curved, and elastic layer 28 is cylindrical.

The folding creases 30 are generated by advancing sheet 12 through the gap between creasing cylinder 21 and counter cylinder 23.

The interaction between creasing plate 24 and sheet 12 is shown in more detail in FIG. 4.

Creasing projections 26 are formed at creasing plate 24 by repeatedly and locally deforming the material of creasing plate 24 so as to generate the creasing projections 26 in the desired pattern. In order to allow for the desired plastic deformation, creasing plate 24 is formed from steel, in particular from carbon steel or stainless steel. It preferably has a thickness in the order of 0.2 to 0.6 mm.

For generating the creasing projections 26, a punching module 40 is provided, in particular a turret punching machine or a coil punching machine. Punching machines of these types are generally known. They however are preferably slightly adapted for being used in combination with the creasing machine. In particular, punching module 40 may not be as versatile and powerful as a conventional punching machine as it only has to perform a very limited number of different operations (namely generating generally straight creasing projections) in a rather thin material.

Punching module 40 is schematically shown in FIG. 1 with a punch 42 used for plastically deforming a creasing plate blank 24'.

Further, punching module 40 comprises a turret 44 in which a plurality of different punches 42 is stored.

FIG. 5 schematically shows how punching module 40 generates a creasing projection 26 by repeatedly plastically deforming creasing plate blank 24'. With full lines, punch 42 is shown which cooperates with a die 46 positioned on the opposite side of creasing plate blank 24'. With dashed lines, the position of punch 42 during the previous punching stroke is shown, and dotted lines indicate the position of punch 42 during the again proceeding punching stroke.

Each stroke generates a small, plastically deformed area at the creasing plate blank 24', with the entirety of the plastically deformed areas forming the creasing projection (s) 26.

FIGS. 6*a* to 6*c* show different embodiments of the punch arranged on a carrier 43.

In FIG. 6*a*, a punch 42 with a comparatively short projecting portion 45 is shown. The length of the projecting portion can be in the order of one centimeter.

At its ends which are opposite each other when viewed along the longitudinal direction of the projecting portion 45, comparatively small radii are provided. They can be in the order of 0.2 to 2 millimeters.

In FIG. 6*b*, a punch 42 is shown in which the projection portion 45 is approximately three times the length of the projecting portion 45 of the punch 42 shown in FIG. 6*a*. It can be seen that the radii at the opposite ends of the projecting portion are comparatively large.

In FIG. 6*c*, a punch 42 is shown which has different radii at the opposite ends of the projecting portion 45. There is a small radius $R_1$ which is in the order of 0.2 to 2 millimeters only, and there is a large radius $R_2$ which can be in the order of 2 to 15 millimeters.

The height H (please see also FIG. 10) with which the projecting portion 45 projects over the forward end face of punch 42, is in the order to 1 to 2 mm.

FIGS. 7*a* and 7*b* show an embodiment of die 46 adapted for cooperating with punch 42 and mounted on a carrier 47.

Die 46 has a support surface 48 at which creasing plate blank 24' may abut during the punching operation. Within support surface 48, a recess 50 is provided. Recess 50 is sized so as to receive the plastically deformed material of creasing plate blank 24' forming the creasing projection 26.

As can be seen in FIGS. 7*a* and 7*b*, recess 50 is open at its opposite ends.

It can further be seen in FIG. 7*a* that the outer contour of die 46 adjacent one of the open ends of recess 50 extends inclined with respect to the longitudinal direction of recess 50. In particular, the outer contour at each side of recess 50 extends at an angle of 45° with respect to the longitudinal direction of recess 50.

At the opposite end of recess 50, the outer contour of die 46 extends perpendicularly with respect to the longitudinal direction of recess 50.

An elastic ejector 58 is arranged at die 46. Ejector 58 is formed as a plate from rubber or an elastomer and snugly surrounds die 46 so that it stays at the position shown in FIG. 7*b* without any additional measures.

In FIG. 8, a different embodiment of die 46 is shown. Here, die 46 has the inclined contour at both open ends of recess 50 (please see the portions to which arrows P point).

In FIG. 9, a conventional die 46 is shown which has a circular support surface 48.

In FIG. 10, a schematic cross section through the punch 42 cooperating with die 46 is shown.

The creasing plate blank 24' is held, during the process of locally plastically deforming it so as to create the creasing projections 26, between die 46 and the carrier 43. Carrier 43 is here spring loaded towards die 46 so as to act in the manner of a clamp.

This avoids tension in the creasing plate blank 24' which could result in unwanted deformations.

In FIGS. 11*a* and 11*b*, it is schematically shown how adjacent creasing projections 26 can be formed by means of the punch cooperating with die 46. For better clarity, the punch and the creasing plate are not shown in FIG. 11*a*. Rather, only creasing projections 26 formed at creasing plate 24 are shown.

The creasing projection 26 extending towards the left in FIG. 11*a* is a projection which was previously formed. The creasing projection 26 extending through the recess in die 46 is the creasing projection currently formed together with punch 42. It can be seen that the "new" creasing projection 26 can be formed to a point where it is immediately adjacent the "old" creasing projection 26.

The result of the immediately adjacent creasing projections 26 is visible in FIG. 11*b* where folding creases 30 are shown which are arranged at a 90° angle with respect to each other and which almost merge into each other. Since very little uncreased material remains in the corner between the folding creases 30, a very precise fold can be achieved in this area.

In FIGS. 12*a* to 12*e*, it is shown how three creasing projections 26 can be formed at a creasing plate. Due to the particular contour at one of the open ends of recess 50, the three creasing projections 26 can almost merge into each other at an intersection point. It can be seen in FIG. 12*d* where such creasing projections 26 can be used for forming folding creases 30 at a sheet 12.

These creasing projections are aimed to fold a composite flap of a crash lock bottom box or of a four corner or six corner tray.

Punching module 40 is capable of producing different creasing plates 24 by appropriately deforming a creasing plate blank 24' at the required locations. It is in particular possible for the creasing machine, in particular for a schematically shown control 60 of the creasing machine, to determine, upon receipt of data for a new creasing job, whether a new creasing plate 24 is to be manufactured or whether an "old" creasing plate used in a previous creasing job can be used. Depending on the determination, control 60 either initiates that punching module 40 manufactures a new creasing plate 24, or that the "old" creasing plate 24 is retrieved from an inventory 62 where the previously manufactured creasing plates 24 are being stored.

The creasing plate 24 (either newly manufactured or retrieved from inventory 62) is taken over by handling system 64 and is then mounted at the creasing tool.

If the creasing tool is a punch, the plate is mounted in a flat shape. If the creasing tool is a creasing cylinder, creasing plate 24 can be either bent and clamped to creasing cylinder 23, or a circumferentially closed creasing sleeve can be formed which can then be mounted to creasing cylinder 23.

As is explained above, a punch having larger radii at opposite sides (to be precise: having larger radii at opposite sides of its projecting portion 45) is used for obtaining creasing projections 26 which have a smooth transition between the material deformed with each stroke of the punch. FIG. 13*a* shows creasing projections 26 which terminate at a larger distance from each other. The creasing projections 26 very smoothly merge into the creasing plate 24.

FIG. 13*b* shows two creasing projections 26 which terminate in a very small distance from each other so as to almost merge into each other. These creasing projections 26 are obtained by using a punch 42 which has at least at its "forward" end (referring to the direction in which the creasing plate blank 24' is displaced during consecutive strokes) a small radius. The small radius allows for a comparatively steep rise of the creasing projection 26 from the creasing plate 24 so that a small distance between adjacent ends of the creasing projections 26 is possible.

It can be seen that the ends of the creasing projections which are at the opposite ends, terminate with a larger radius.

Figure 14A:
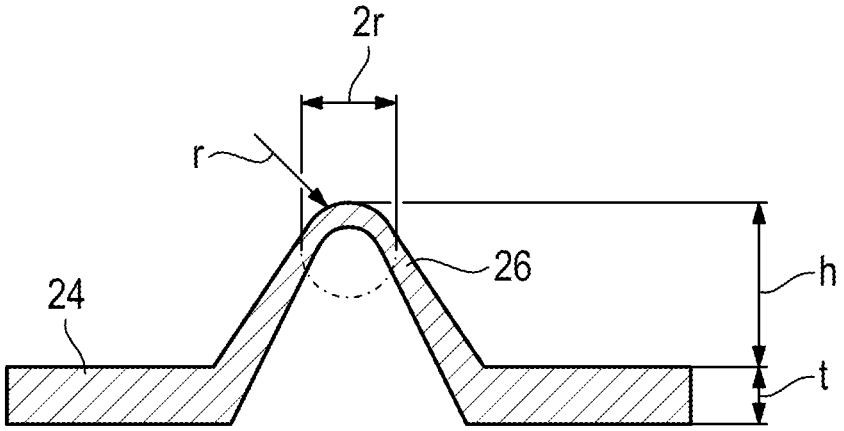
Figure 14B:
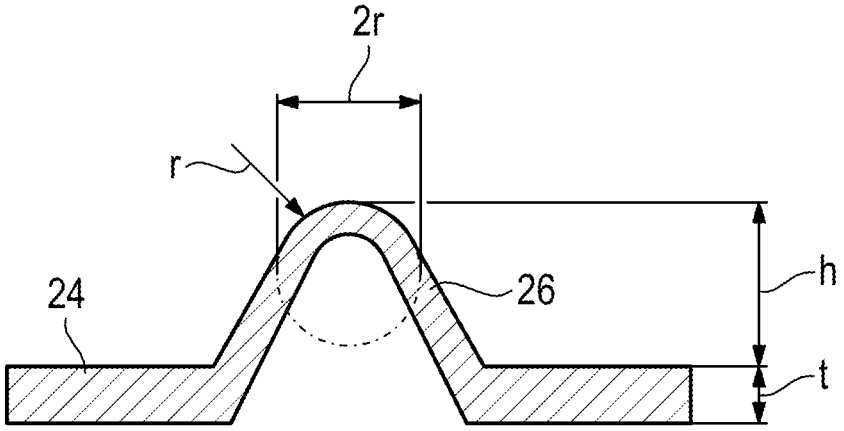

FIGS. 14*a* and 14*b* show cross sections through creasing projections 26 which have been proven to be very effective for creasing carton.

In FIG. 14*a*, the creasing plate has a thickness in the range of 0.4 mm while the height h of the creasing projection is in the range of 0.6 to 1.6 mm.

Depending from the particular carton to be creased, the radius R at the apex of the creasing projection 26 can be in the range of 0.25 to 0.7 mm. In other words, the apex matches an inscribed circle with a diameter of 2R.

Preferred values for the height h are in the region of 1.2 mm, while preferred radii can be 0.35 mm and 0.525 mm.

In FIG. 15*a*, a creasing projection 26 for creasing corrugated cardboard is shown. It can be seen that a much wider creasing projection is used as compared to the profiles shown in FIGS. 14*a* and 14*b*. In particular, the angle $\alpha$ is more than 90°. According to a preferred embodiment, this angle can be in the range of 110 to 120°, in particular 114°.

The wider conical shape of the profile of creasing projection 26 is effective to compress the carton on each side of the crease so as to create the space which is necessary for folding the corrugated cardboard (because of its increased thickness), thereby reducing the tension which is generated when the carton is folded.

Here again, a typical height of the creasing projection 26 is in the region of 1.2 mm. As the radius R at the apex of the profile, a value in the order of 0.5 to 0.6 mm is suitable, in particular 0.53 mm.

As a radius R at the base of creasing projection 26, a value in the order of 0.5 mm has been proven to be beneficial.

An inscribed circle here again can have a diameter of 1.05 mm.

It is important to note that the creasing projections 26 on one and the same creasing plate 24 can have different heights, depending from the particular requirements.

FIGS. 16*a* and 16*b* show an advantageous aspect of the creasing tool.

When changing from creasing cardboard to creasing corrugated carton, it is necessary to change the crease direction. This can very easily be done by changing the function of the two cylinders 21, 23.

In FIG. 16*a*, the upper cylinder acts as the counter cylinder 23 while the lower cylinder is the creasing cylinder 21. Accordingly, the elastic layer 28 is mounted to the upper cylinder while creasing plate 24 is mounted to the lower cylinder.

In the configuration shown in FIG. 16*b*, this arrangement is reversed. The elastic layer 28 is mounted to the lower cylinder while creasing plate 24 is mounted to the upper cylinder. Thus, the upper cylinder acts as creasing cylinder 21 while the lower cylinder acts as counter cylinder 23.

It is however the same set of cylinders which is being used. The function of the cylinder is simply determined by the "tool" mounted to it (either creasing plate 24 or elastic layer 28). Accordingly, both cylinders are provided with identical clamping mechanisms (here very briefly indicated with reference numeral 60), and the cylinders have the same diameter.

The functional outer radius of both cylinders depends from the tool mounted to it. In particular, the functional outer radius of the cylinder provided with the elastic layer 28 is larger than the functional radius of the cylinder provided with creasing plate 24. Accordingly, the plane in which sheet 12 is advanced through the creasing area between the cylinders has to be adjusted depending from the particular configuration. The respective $\Delta$ is indicated between FIGS. 16*a* and 16*b*.

The vertical adjustment of the plane in which sheets 12 are provided can either be obtained by vertically adjusting the feeding device which advances the sheets, or by vertically adjusting the two cylinders 21, 23 with respect to the feeding plane.

Another consequence from the functional radius of the two cylinders being different is that the speed of rotation of the cylinders is slightly different as the tangential speed at the point of engagement at the sheets 12 has to be the same. Further, it has to match the speed with which the sheets 12 are advanced through the creasing tool.

In order to allow for an individual control of the speeds of rotation, each cylinder is provided with a servo motor 62 which is controlled by means of a machine control 64. Machine control 64 is also provided with a signal relating to the position of the clamping devices 60 as they form a dead zone where no creasing can be made.

Machine control 64 is furthermore provided with a signal relating to the position of the sheets 12 advanced through the creasing tool. This signal can be obtained via a sensor 66 which for example detects the leading edge of the sheets 12 upstream of the creasing tool.

Based on the effective radii $R_E$, the speed V with which the sheets 12 are advanced through the creasing tool, and the signal from sensor 66, machine control 64 suitably controls the servo motors 62 so as to achieve the proper speed of rotation U for each of the cylinders and also the correct position of the dead zone with respect to the individual sheets.

For manufacturing creasing plate 24, it has to be kept in mind that the creasing plate blanks 24' are deformed when being in a flat shape while the creasing plates are mounted, when installed on a creasing cylinder 21, in a curved shape. This results in the creasing projections 26 having, when the creasing plate is mounted to the creasing cylinder 21, a distance from each other which is larger than in the flat configuration of the creasing plate.

As can be seen in FIGS. 18 and 19, the creasing projections 26 are pressed into the carton to be creased by a certain distance (for example 1 mm) which however is less than the total height of the creasing projection. It is however preferred that the outer surface of creasing plate 24 does not touch the upper surface of sheets 12. Accordingly, a gap exists between the outer surface of creasing plate 24 and the upper surface of sheet 12.

FIG. 18 shows in an example the straight real length L between two creases 30, measured in parallel with the feeding direction of sheet 12. The same curved real length L can be measured between the apex of the corresponding creasing projections 26 on the functional, effective radius $R_E$. It can be seen that in a developed, flat condition of creasing plate 24, because of the difference between the development radius $R_D$ and the functional, effective radius $R_E$, the developed length $L_D$ is less than the real length L. Accordingly, two creasing projections 26 have to be formed on the creasing plate 24 in a distance, parallel to the feeding direction, which is less than the actual distance which the respective creases shall have on sheet 12.

In FIGS. 20*a* and 20*b*, another aspect of the creasing tool is shown.

Typically, sheet 12 is driven between the creasing cylinder 21 and the counter cylinder 23 by the contact of the creasing projections 26 with the sheet and also because of the contact of the sheet with the counter cylinder. However, there are creasing configurations where at a certain point in time, no creasing projection 26 engages at sheet 12. Because of the gap G explained with reference to FIGS. 18 and 19, no proper driving force would be exerted onto sheet 12 in these points in time.

To ensure that sheet 12 is always positively driven irrespective of the particular position of creasing projections 26, a driving fillet 27 is provided which extends in a circular direction along the entire creasing plate 24. Driving fillet 27 can be a plastically deformed portion of creasing plate 24 in the same manner as the creasing projections 26.

It is however also possible to create driving fillet 27 in a different manner. As an example, an epoxy fillet could be added to the creasing plate in a separate manufacturing operation. Such driving fillet can be seen in FIG. 20*c*.

Driving fillet 27 does not have to project over the surface of creasing plate 24 in a manner which creates a distinct crease in sheet 12. The height can be chosen mainly in view of the intended driving force which shall be generated.

FIGS. 21*a* to 21*c* show the clamping mechanism 60 in more detail.

The clamping mechanism 60 is effective to anchor both ends of either creasing plate 24 or elastic layer 28 and force both ends towards each other equally. This ensures that the respective sleeve is correctly located around the cylinder. Further, this avoids problems with air pockets being trapped under the sleeve. Such air pockets could result in damage to the creasing plate 24 or the elastic layer 28 when the respective sleeve is put under pressure in operation.

FIGS. 22*a* to 22*g* show an additional aspect of the creasing machine.

In this embodiment, a sleeve of a shape memory material 29 is used on counter cylinder 23 instead of elastic layer 28. Shape memory material layer 29 is plastically deformed by means of creasing plate 24.

Figure 22A:
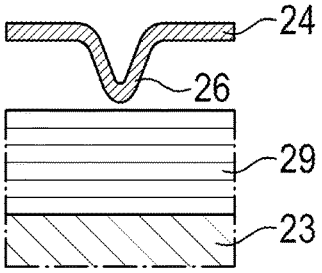

In FIG. 22*a*, creasing plate 24 has been mounted to creasing cylinder 21 while layer 29 having in a starting condition with a flat surface is mounted to counter cylinder 23.

Figure 22B:
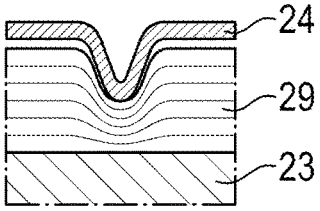

For shaping layer 29, the two cylinders 21, 23 are advanced towards each other so that creasing projections 26 on creasing plate 24 penetrate into layer 29 (please see FIG. 22*b*).

Figure 22C:
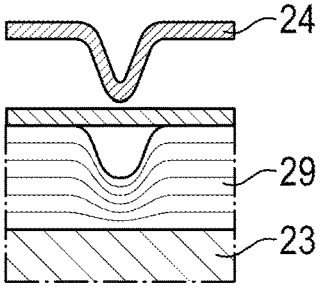

After increasing the distance between cylinders 21, 23 (and after curing, if necessary), layer 29 has the shape of a counter die to creasing plate 24 (please see FIG. 22*c*).

Figure 22D:
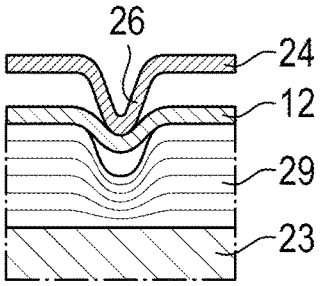
Figure 22E:
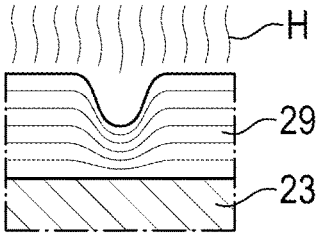
Figure 22F:
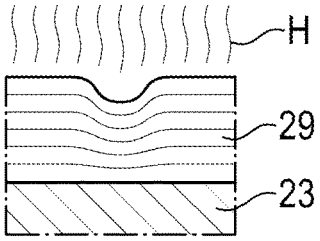
Figure 22G:
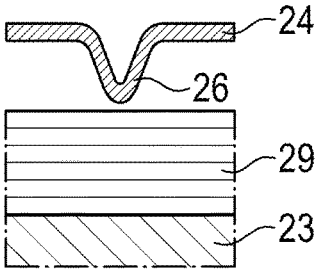

Subsequently, creasing cylinder 21 with creasing plate 24 and counter cylinder 23 with layer 29 can be used for creasing sheets 12 (please see FIG. 22*d*).

After a certain creasing job has been finished, layer 29 is restored to its original condition. To this end, layer 29 can be heated (schematically indicated with reference numeral H in FIGS. 22*e* and 220 so that the depressions in layer 29 are "erased".

When layer 29 has been restored to its original flat shape (please see FIG. 22*g*), the creasing machine is ready for the next creasing job which starts by creating a new counter die by deforming layer 29 with the new creasing plate 24.

Figure 23A:
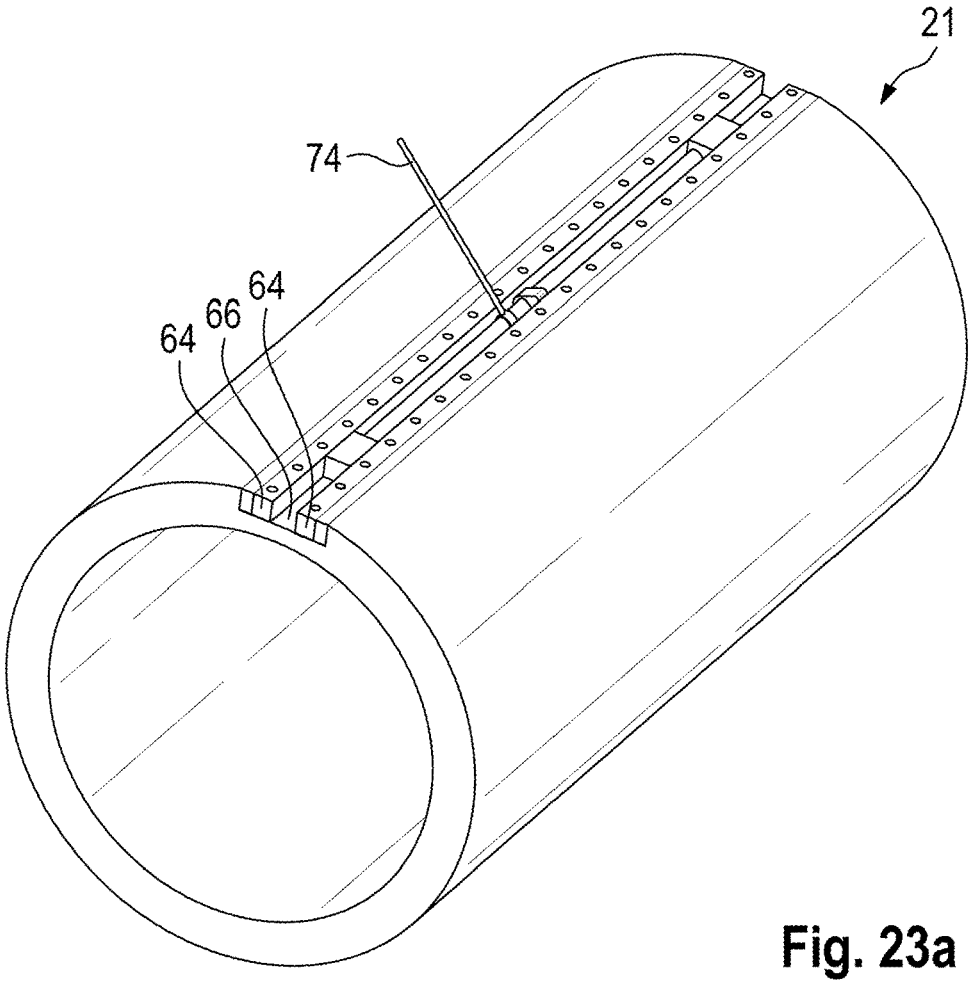
Figure 23B:
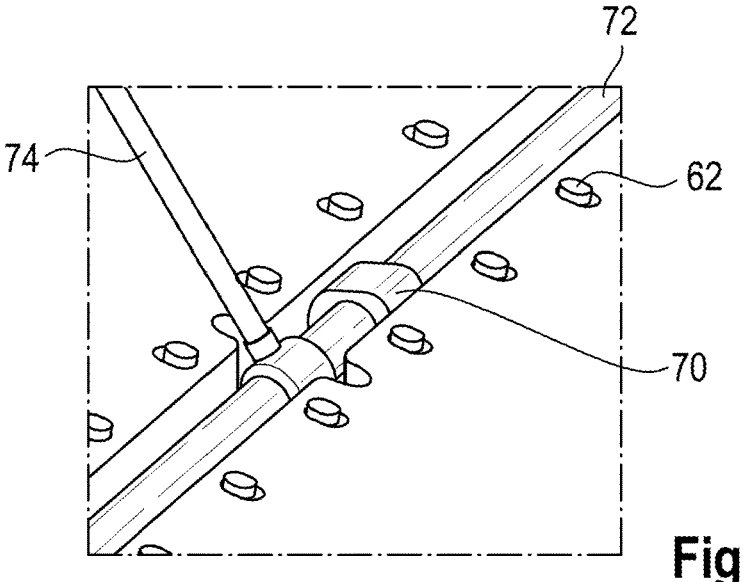
Figure 23C:
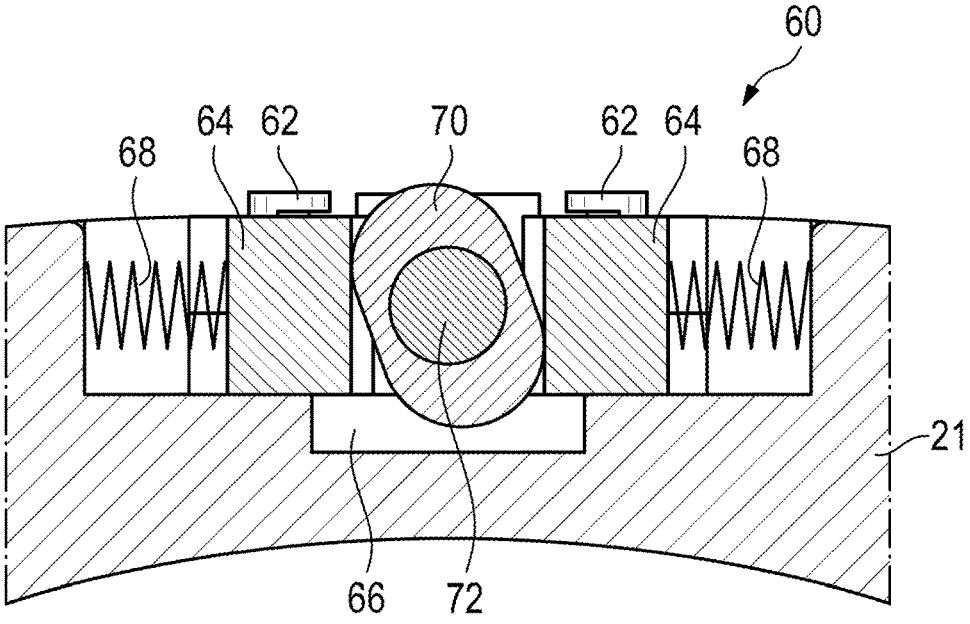
Figure 24A:
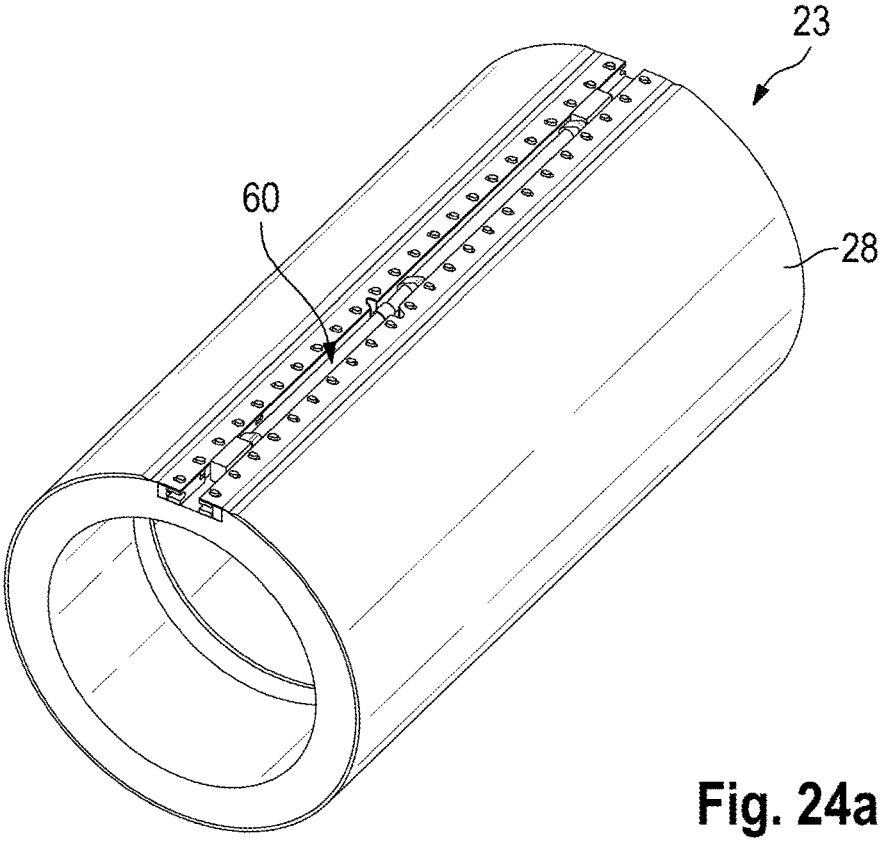
Figure 24B:
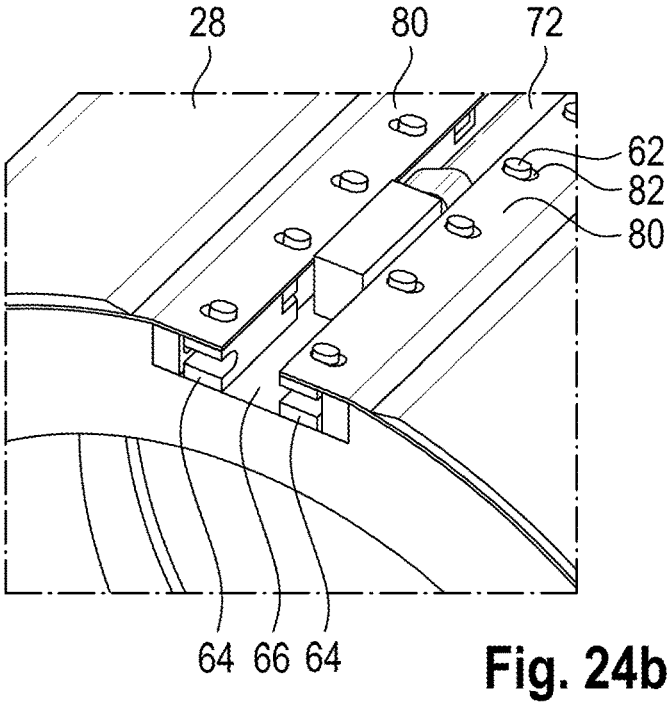

FIG. 23*a* shows the creasing cylinder 21 in more detail.

Figure 23D:
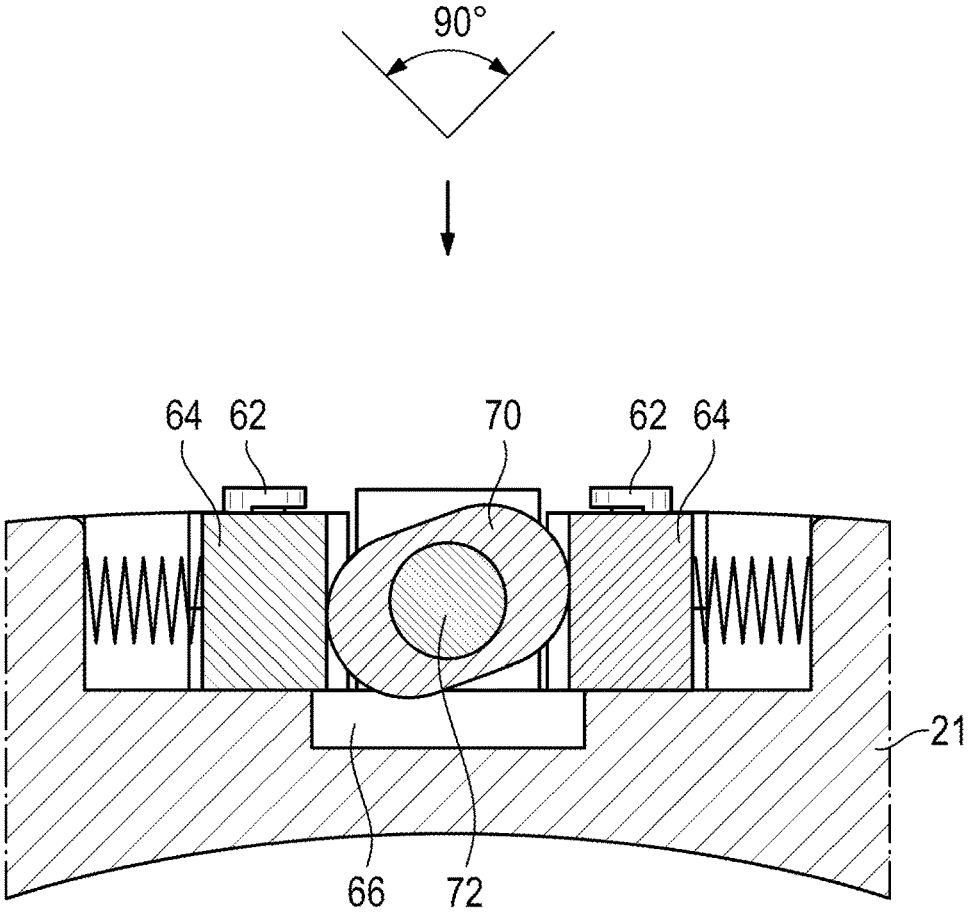

The clamping mechanism 60 has clamping pins 62 which are moveable between a clamping position (shown in FIG. 23*c*) and a release position (shown in FIG. 23*d*).

In the release position, the clamping pins 62 are spread apart as compared with the clamping position. Looking at FIGS. 23*c* and 23*d*, the distance between the clamping pins 62 in the clamping position is less than in the release position. In other words, a creasing plate 24 having holes into which the clamping pins 62 engage, is pulled to the outer circumference of the creasing cylinder when the clamping pins are in their clamping position.

The clamping pins 62 are mounted to sliding elements 64 which are arranged in a groove 66 formed in the creasing cylinder 21. The sliding elements 64 are biased by means of schematically shown springs 68 towards the center of the groove 66 and thus towards each other (and into the clamping position).

A release mechanism is provided for moving the clamping pins 62 from the clamping position into the release position. The release mechanism is here formed as a cam mechanism.

The cam mechanism has a plurality of cams 70 which are mounted non-rotatably on a shaft 72. The shaft is mounted rotatably in groove 66. Cams 70 are symmetrical with respect to the center of shaft 72. Thus, there are two apexes spaced by 180°.

Shaft 72 is provided with a bore for receiving an actuating tool 74 which can be a simple rod. The actuating tool 74 allows rotating the shaft and thus the cams 70 from the rest position shown in FIG. 23*c* to the spreading position shown in FIG. 23*d*.

In the rest position, the cams 70 do not exert notable forces on the sliding elements 64 so that they are urged by springs 68 towards each other into the clamping position.

In the spreading position, the cams urge the sliding elements 64 apart into the release position, against the force of the springs 68.

The amount of rotation of shaft 72 for transferring the cams 70 from the rest position into the spreading position is approx. 90°. It can be seen that in the spreading position, the cams 70 are moved "beyond" the dead center position in which the two apexes are arranged horizontally when looking at FIG. 23*d*, ensuring that the release mechanism reliably remains in the spreading position with the clamping pins 70 in the release position.

For mounting a creasing plate, the clamping pins 62 are brought into their release position. Then, the creasing plate is mounted at the creasing cylinder 21 such that the clamping pins engage into holes provided close to the edges of the creasing plate which are arranged opposite each other. Then, the release mechanism is returned into the rest position such that the clamping pins 62, under the effect of springs 68, pull the creasing plate 24 tight against the outer circumference of the creasing cylinder.

The clamping pins 62 are in the form of hooks so there is a slight undercut into which the creasing plate engages. This ensures that the creasing plate is mechanically held "under" the clamping pins 62 and cannot disengage axially outwardly when being clamped to the ceasing cylinder.

FIGS. 24*a* and 24*b* show the same clamping mechanism 60 which is known from the creasing cylinder.

The elastic layer 28 has a reinforcement plate 80 which is provided with holes 82 into which the clamping pins 62 engage.

The invention claimed is:

1. A punching tool for manufacturing a creasing plate, the punching tool comprising:

a punch, wherein the punch has a projection with rounded portions, and wherein the rounded end portions have opposite ends having different radii; and a die having a straight recess for accommodating material deformed by the punch, wherein the straight recess extends along a top surface of the die from a first end of the die to a second end of the die, and wherein the die includes an outer perimeter intersecting the top surface and including an inclined portion that is inclined from an end of the straight recess at the first end towards the second end at an angle of less than 90° between a longitudinal axis of the straight recess and a longitudinal axis of the inclined portion so that a width of the top surface varies from the first end toward the second end.

2. The punching tool of claim 1, wherein the angle is in the order of 45°.

3. The punching tool of claim 1, wherein one or more of the different radii is in the order of 2 to 15 mm.

4. The punching tool of claim 1, wherein one or more of the different radii is in the order of 0.2 to 2 mm.

5. The punching tool of claim 1, wherein the punch extends along a straight line and has a length, measured along the straight line, in the order of 5 mm to 50 mm.

6. The punching tool of claim 1, further comprising an elastic ejector for the die.

7. The punching tool of claim 6, wherein the elastic ejector is a plate made from rubber or an elastomer.

8. The punching tool of claim 6, wherein the elastic ejector surrounds the die.

9. The punching tool of claim 1, wherein the punch has a projecting portion with a height in the order of 1.0 to 2.0 mm.

10. The punching tool of claim 1, wherein the punch has a projecting portion with an apex, the apex having a radius, when viewed in a cross section perpendicularly to the longitudinal direction of the projection portion, which is in the order of 0.1 to 0.5 mm.

11. The punching tool of claim 1, wherein the punch has a projecting portion which has, when viewed in a cross section perpendicularly to the longitudinal direction of the projection portion, a width in the order of 0.5 to 4 mm.

12. A punching tool comprising:

a punch;

a die having a straight recess for accommodating material deformed by the punch, wherein the straight recess extends along a top surface of the die from a first end of the die to a second end of the die, and wherein a width of the top surface along an outer perimeter of the die varies from the first end toward the second end;

an elastic ejector having an inner perimeter matching the outer perimeter of the die to surround the die and push the material deformed by the punch out of the die; and a carrier;

wherein the die and the elastic ejector are mounted on the carrier, and wherein an outer perimeter of the elastic ejector matches an outer perimeter of the carrier.

13. The punching tool of claim 12, wherein a height of the die is equal to a height of the elastic ejector so that a top surface of the elastic ejector is aligned with the top surface of the die.

14. A punching tool comprising a punch having a projecting portion having a rounded end, wherein the projecting portion has opposite ends having different radii; and a die having a straight recess for accommodating material deformed by the rounded end, wherein the straight recess extends along a top surface of the die from a first end of the die to a second end of the die, and wherein a width of the top surface increases from the first end toward a center of the die.

15. The punching tool of claim 14, wherein the different radii include a small radius and a large radius, wherein the small radius and the large radius are each a radius of curvature of the projecting portion.

16. The punching tool of claim 14, wherein the width of the top surface increases from the second end toward the center of the die.

* * * * *